United States Patent [19]

Wooldridge

[11] Patent Number: 4,552,058

[45] Date of Patent: Nov. 12, 1985

[54] AIR FLOW CONTROL SYSTEM HAVING MINIMUM VARIATION IN VOLUME

[75] Inventor: James E. Wooldridge, Louisville, Ky.

[73] Assignee: Allis-Chalmers Corporation, Milwaukee, Wis.

[21] Appl. No.: 553,797

[22] Filed: Nov. 21, 1983

[51] Int. Cl.[4] ..... B64D 13/00

[52] U.S. Cl. ..... 98/1.5; 417/12; 55/215; 165/16

[58] Field of Search ..... 236/49; 165/16; 417/12; 98/1.5; 55/215

[56] References Cited

U.S. PATENT DOCUMENTS 4,251,027 2/1981 DeHart et al. ..... 236/49

4,407,185 10/1983 Haines et al. ..... 417/2

*Primary Examiner*—Henry Bennett

*Attorney, Agent, or Firm*—Donald C. McGaughey

[57] ABSTRACT

An air volume control ventilation system which minimizes variation in air volume flowing through the system has a fan for drawing air through fixed-resistance filter means including a roll filter, an electrostatic filter, and a high efficiency filter; a variable-resistance volume control damper operated, when an actuator therefor is energized in opposite directions, to open and to close and thus vary the volume of air flowing through the system; and a differential static pressure switch connected across the fan and being provided with a normally open high limit set of contacts adapted to close and complete a circuit to open the damper when the differential pressure across the switch rises to a first predetermined limit and also a low limit set of normally open contacts adapted to close and complete a circuit to shut the damper when the differential pressure falls below a second predetermined limit, whereby the damper is alternately open and shut and the differential pressure across the fan is maintained within a narrow band between the first and second limits.

10 Claims, 4 Drawing Figures

AIR FLOW CONTROL SYSTEM HAVING MINIMUM VARIATION IN VOLUME

BACKGROUND OF THE INVENTION

This invention relates to air ventilation systems and, in particular, to an air flow control system which has minimum variance in air volume delivery.

Several problems are involved in maintaining a reasonably constant volume of air flow in any air supply system. The term "system" refers to the external physical installation to which the fan is connected and is any combination of air flow passages and apparatus which imposes resistance to the flow of the air. The system is usually comprised of duct work and connections, heaters, air washers and filters, economizers, preheaters, furnaces, etc., and the pressure required to force air through such a system is dependent upon the rate of volumetric flow. The system resistance is usually expressed in terms of the design volume in cubic feet per minute (cfm) and the particular static pressure in inches of water column (W.C.) required to maintain the flow at the design rate.

One problem involves the characteristics of the fan which results in a reduction of air volume for any increase in static pressure requirement.

Another problem of maintaining a reasonably constant volume of air flow in the air supply system is that the system components manifest a pressure drop differential proportional to the volume of air flowing through them. Some components of the system exhibit a pressure drop which approaches a linear proportion, while other components exhibit an exponential relationship. Most components as a rule of thumb are assumed to follow the square law, i.e., the pressure differential across them increases (or decreases) as the square of the increase or decrease in air volume.

Because of such varying proportionalities between pressure drop and volume of air flowing through the system components, the designer of an air supply system must select an operating point on the fan performance curve for a given rpm and then allow the air volume to fluctuate between an upper limit and a lower limit as the components, such as the filters, become loaded. The designer may decide to choose a point between such lower and upper limits as the desired operating point with a corresponding volume of air flow. In reality, the actual air volume will normally be above such operating point (and thus be too high) or below the selected operating point (and thus be too low). In larger air ventilation systems such variance can be substantial. For example, an air flow system designed as described above for 30,000 cfm and having a static pressure range of 1.5" W.C. may typically have an air flow swing of 5,000 cfm or more; which constitutes a variation of almost 17% in air volume.

While the air flow system design just described may be the most practical approach, in some applications such design approach is not acceptable and the variation in air volume must be maintained within closer tolerances. Elaborate and costly monitoring systems are utilized for keeping the air flow volume stabilized in air ventilating systems.

It is an object of the invention to provide an improved air ventilation control system which stabilizes the volume of air flow in a simpler manner and at lower cost than prior art systems.

Another object is to provide such an improved volume control ventilation system which introduces artificial variable resistance to the air flow that permits substantial reduction in air volume fluctuations in comparison to prior art systems.

It is another object of the invention to provide an improved air ventilation system which controls the air volume to allow the fan, or blower, differential pressure to operate within 0.1" W.C. or less. A further object is to provide such improved air flow control system wherein the air volume fluctuations are reduced as low as 5%, or even as low as 3%, of the nominal system capacity.

In indoor gun firing ranges it is important to maintain the air volume supplied by the air ventilation system within very close tolerances. Specifications for such indoor firing ranges require that the air velocity moving past the marksman must not be below 75 feet per minute and must not be allowed to increase sufficiently so that vortexes are created. It is a specific object of the invention to provide an air ventilation supply system wherein the minimum velocity of the air at the firing line of such indoor firing range is 75 feet per minute and the maximum variation in air volume from this criteria is not more than 5–10 feet per minute, thereby avoiding any problem of creation of vortexes.

BRIEF DESCRIPTION OF THE DRAWING

The above and other objects and advantages of the invention will be more readily apparent when considered together with the accompanying drawing wherein.

SUMMARY OF THE INVENTION

An air volume control ventilation system embodying the invention has a fan for supplying air through ductwork and fixed-resistance filter means including an electrostatic filter and is provided in accordance with the invention with a variable resistance volume varying means such as a control damper actuable in opposite directions to respectively increase and to decrease the volume of air flowing in the system, and thus adjust the system differential pressure, and means for monitoring the static pressure differential across the fan and for completing first and second circuits to operate the control damper in opening and in closing directions when the differential pressure across the fan increases above a first predetermined limit and falls below a second predetermined limit respectively, whereby the control damper is alternately opened and shut and the differential pressure across the fan is maintained within a narrow band between the first and second predetermined limits to thereby minimize the variation in air volume flowing through the system.

DETAILED DESCRIPTION OF THE PREFERRED EMBODIMENT

Figure 1:
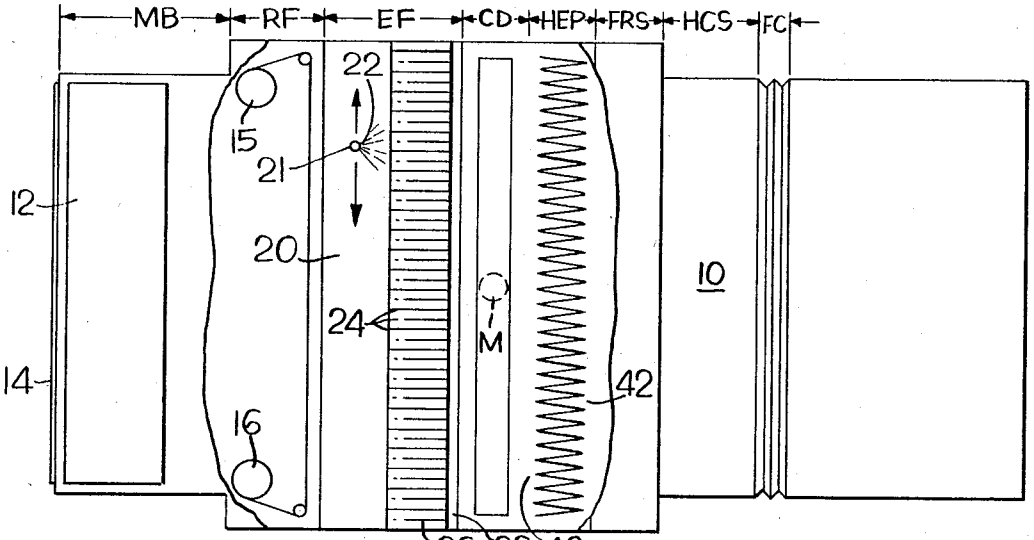
FIGS. 1 and 2 are plan and side elevation views respectively of an air flow control system embodying the invention with the functions of certain components represented schematically.
Figure 2:
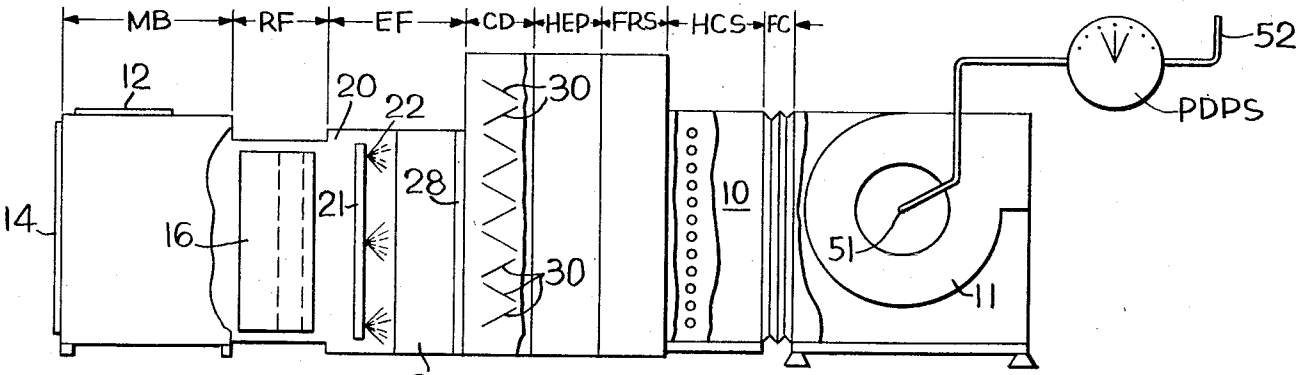

FIGS. 1 and 2 are plan and side elevation views respectively, of an air flow volume control system 10 for an indoor firing range wherein air is drawn by a fan 11 in series through: (a) an air inlet mixing box MB which controls the amount of recirculated and fresh air supplied to the firing range and may have, for example, a top air inlet 12 and a front inlet 14; (b) an automatic roll filter RF (or prefilter for the electrostatic filter) of the type disclosed in U.S. Pat. Nos. 3,020,976; 3,276,191 and 3,350,853, having a supply roll 15 of new filter media at one end from which the clean filter media is periodically introduced across the path of the airstream and a take-up spool 16 at the opposite end on which the spent filter media is rewound; (c) an electrostatic filter EF; (d) air volume varying means shown as a control damper CD operable when an internal actuator motor M is energized in one direction to open and increase the volume of air flowing through system 10 and to shut and decrease the volume of air flowing through system 10 when motor M is energized in the opposite direction; (e) a high efficiency particulate air filter HEP designed for face velocities up to 500 feet per minute (FPM) which has a downstream section FRS and permits elimination of transitions to other components; and (f) heating and/or cooling coil section HCS between high efficiency filter HEP and a flexible connector FC which precedes fan 11.

Electrostatic filter EF may comprise a front washer section 20 containing a traveling washer header 21 with spinning nozzles 22 which wash filter elements 24 in a rear section 26 which may be energized at 12 to 16 kilovolts. Such traveling washer 21 requires a separate washer control system (not shown) that automatically turns off fan 11; closes control damper CD; cycles the washer 21; allows time for the elements 24 in rear section 26 to drain drip-dry, and then restart fan 11 and allows for a fan-dry period before the filter elements are re-energized. A plurality of metal-mesh filters 28 in rear section 26 are used as overspray filters and keep water out of high efficiency filter HEP.

Control damper CD may comprise a plurality of pivoted parallel blade louvers 30 operable by an internal motor M between a vertical fully closed position wherein they obstruct flow of air and a horizontal fully open position wherein air flows freely through damper CD. Alternatively the air volume varying means may comprise a variable inlet vane damper.

High efficiency filter HEP may have a front or forward section 40 which contains the filter elements and a rear section 42 containing the necessary sheet-metal transition pieces necessary to match the fan 11 downstream thereof. Flexible connector FC isolates any vibration of fan 11 from the filters upstream thereof.

A photohelic differential pressure switch PDPS such as Model No. 3005 commercially available from F. W. Dwyer Company is connected across fan 11 so as to measure the fan static pressure, i.e., the pressure rise across the fan 11. The low side of switch PDPS is connected to a static tip 51 that is located at the inlet to fan 11 while the opposite side 52 is vented to atmosphere as shown or is located downstream of the fan discharge if there is return ductwork. Static inlet 51 to the fan is located at or near the most negative point in the entire air supply system 10 while the other side 52 of the photohelic switch PDPS is located at or near the most positive point in the system. Any change in resistance in any component of air volume control system 10 will be reflected in the pressure rise across fan 11.

The fan total pressure is the difference between the total pressure at the fan outlet and the total pressure at the fan inlet and is a measure of the total mechanical energy added to the air by fan 11. The fan static pressure is the fan total pressure less the fan velocity pressure at the fan inlet. It can be calculated by subtracting the total pressure at the fan inlet from the static pressure of the fan outlet and is monitored in system 10 by photohelic differential pressure switch PDPS which has: (1) a pair of normally open high limit contacts HI-LIMIT (see FIG. 3) which are set at 5.0" W.C. and close when the static fan differential pressure reaches 5.0" W.C., and (2) a pair of "normally" open low limit LO-LIMIT contacts set at 4.9" W.C. (designated "normally-closed held open") which close only when the pressure differential across fan 11 falls below 4.9" W.C.

As discussed hereinbefore, the designer of an air supply system such as 10 must select an operating point on the fan performance characteristic for a given fan speed and then allow the air volume to fluctuate between an upper limit and a lower limit as the fixed-resistance filters such as RF, EF and HEP in the system 10 become loaded. The designer may choose a point on the static fan characteristic between such upper and lower limits as the desired operating point with corresponding air volume, which means that the actual air volume will be either above or below the desired value. Such variation can be substantial in larger systems, e.g., a fixed-resistance system designed for 30,000 cfm having a static range of 1.5" W.C. may have an air volume swing of 5,000 cfm or more. Such wide variation in air volume is not acceptable for system 10 intended to supply air to an indoor firing stage, and air volume control system 10 stabilizes the volume variation by monitoring the static pressure differential across fan 11 and adjusting the differential pressure across fan 11 by opening and closing volume control damper CD to maintain such differential resistance within narrow limits. Volume varying means such as control damper CD adds artificial variable resistance to system 10, which is important in filters such as electrostatic filter EF for the reason that the slower the air moves through an electrostatic filter, the higher is its efficiency. Specifically, system 10 preferably controls air volume in such a manner to allow the fan static differential pressure to operate within a range of 0.1" W.C., or possibly even less, thereby reducing the air volume fluctuation from the typical range of 12–17% for a fixed-resistance system to 3–5% or less and effectively maintaining control of electrostatic filter EF.

Figure 4:
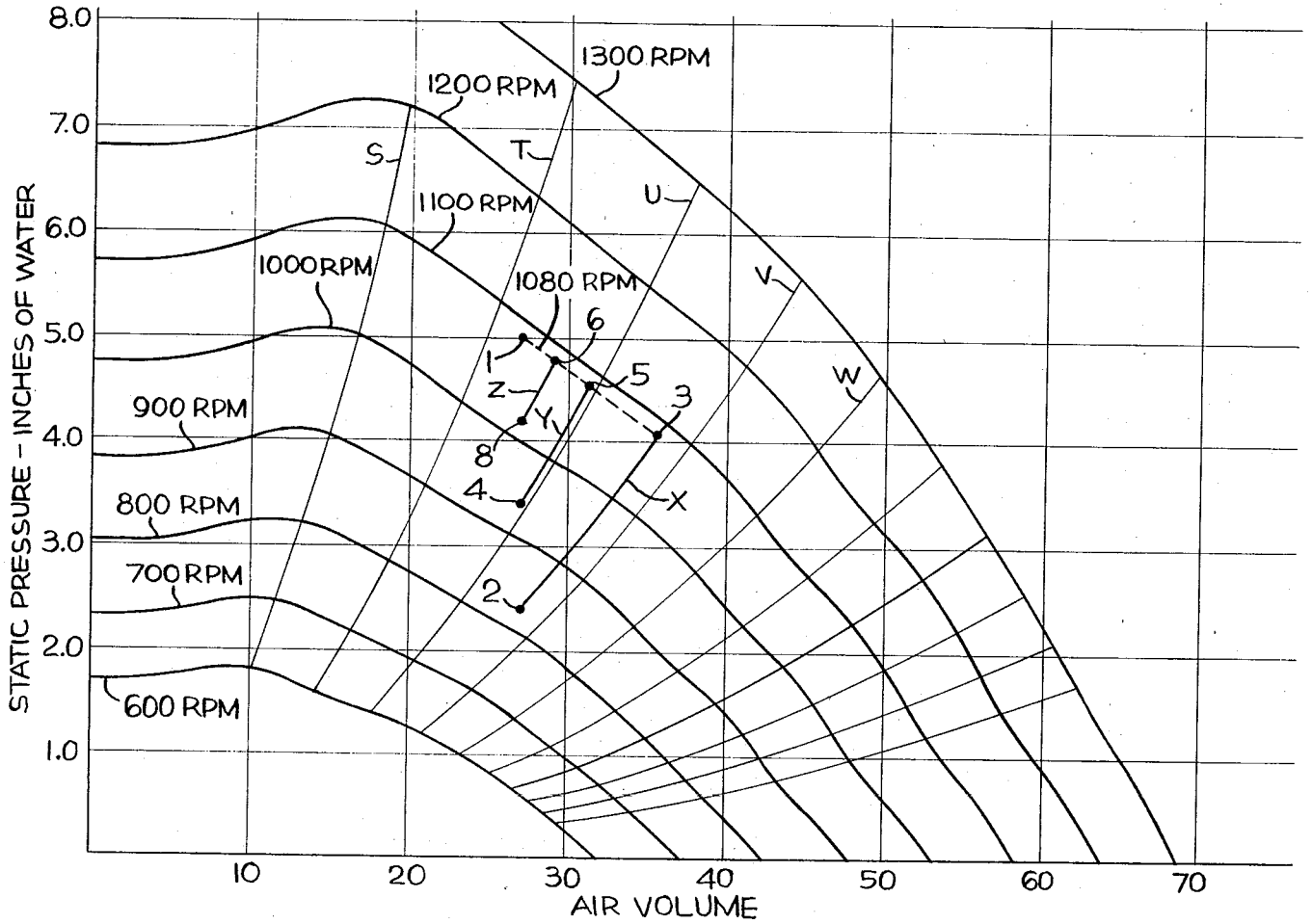
FIG. 4 shows the fan characteristic, i.e., static pressure versus air volume for different rpms of the fan for the system of FIGS. 1 and 2 with air volume system control curves superimposed on the fan characteristic chart using the same set of coordinates.

FIG. 4 shows characteristic curves at speeds from 600 to 1300 rpm for a 36" diameter embodiment of fan 11 having a 18.15 ft. outlet area and a maximum rpm of 1315 driven by a motor of 60 horsepower maximum. The static pressure required to force air through volume control system 10 is dependent upon the rate of volumetric flow. The system resistance is expressed in terms of the same coordinates, i.e., abscissa and ordinate values used to plot the fan characteristics, i.e., the design volume in cfm and the static pressure required to maintain flow at the design rate. In a fixed-resistance system with no variable volume means such as control damper CD, the required pressure rise above atmospheric varies approximately as the square of the air flow volume, and the system characteristics (or average system resistance lines) are curves of simple parobolic form such as designated S, T, U, V and W. Correlation of volume control system 10 characteristic with fan characteristic pressure is accomplished by superimposing the volume control system curves on the fan characteristic chart. The intersection of such system characteristic curve and the fan characteristic curve for a given rpm is the only point at which equilibrium exists. At such point the requirement of the system is satisfied by the available pressure from the fan, and continuous operation results. FIG. 4 also illustrates the effect upon volumetric delivery of variation in the system characteristic from the intended design.

Assume that: (a) system 10 is designed for an air volume of 27,000 cfm at a maximum fan static pressure of 5.0 W.C.; (b) the initial pressure differential of fixed-resistance filters RF, EF and HEP of system 10 is 2.4" W.C.; and (c) the pressure differential for the ductwork in system 10 is 1.0" W.C. A volume of 27,000 cfm and 5.0 W.C. static pressure establishes point (1) where fan 11 is revolving at 1080 rpm.

If system 10 had zero differential ductwork pressure and initial pressure differential of 2.4" W.C. for fixed-resistance filters RF, EF and HEP, the system would be defined by a different system square curve characteristic (X) determined by the 1080 rpm curve and the 2.4" W.C. static pressure at 27,000 cfm volume (point 2), and fan 11 at constant 1080 rpm velocity would have a delivery of approximately 35,500 cfm (interpolated by following system square curve characteristic X from point (2) to point (3) parallel to the system line resistance). When the assumed 1.0" W.C. is added for ductwork in system 10, the system follows a still different system characteristic Y from point (4) on the 27,000 cfm abscissa at 2.4"+1.0.=3.4" W.C. to the 1080 rpm curve to point (5), which is interpolated to indicate a volume of 31,200 cfm.

These values illustrate the variance in air volume delivery with and without ductwork. If variable resistance is now added to the system by control damper CD so that the static pressure rises from 3.4" to 4.2" W.C., system 10 will be defined by still another characteristic Z (determined by 4.2" static pressure (at point 8) and the 1080 rpm constant velocity curve) and the actual fan volume at point 6 will be interpolated to be 29,000 cfm at 4.9" W.C. This value of 29,000 cfm is greater than the 27,000 cfm design value by 2,000 cfm or 7.4%, but it is a considerable improvement over the 31,200 cfm or 35,500 cfm values which comprise 15.5 and 35.5% variation in volume respectively.

Figure 3:
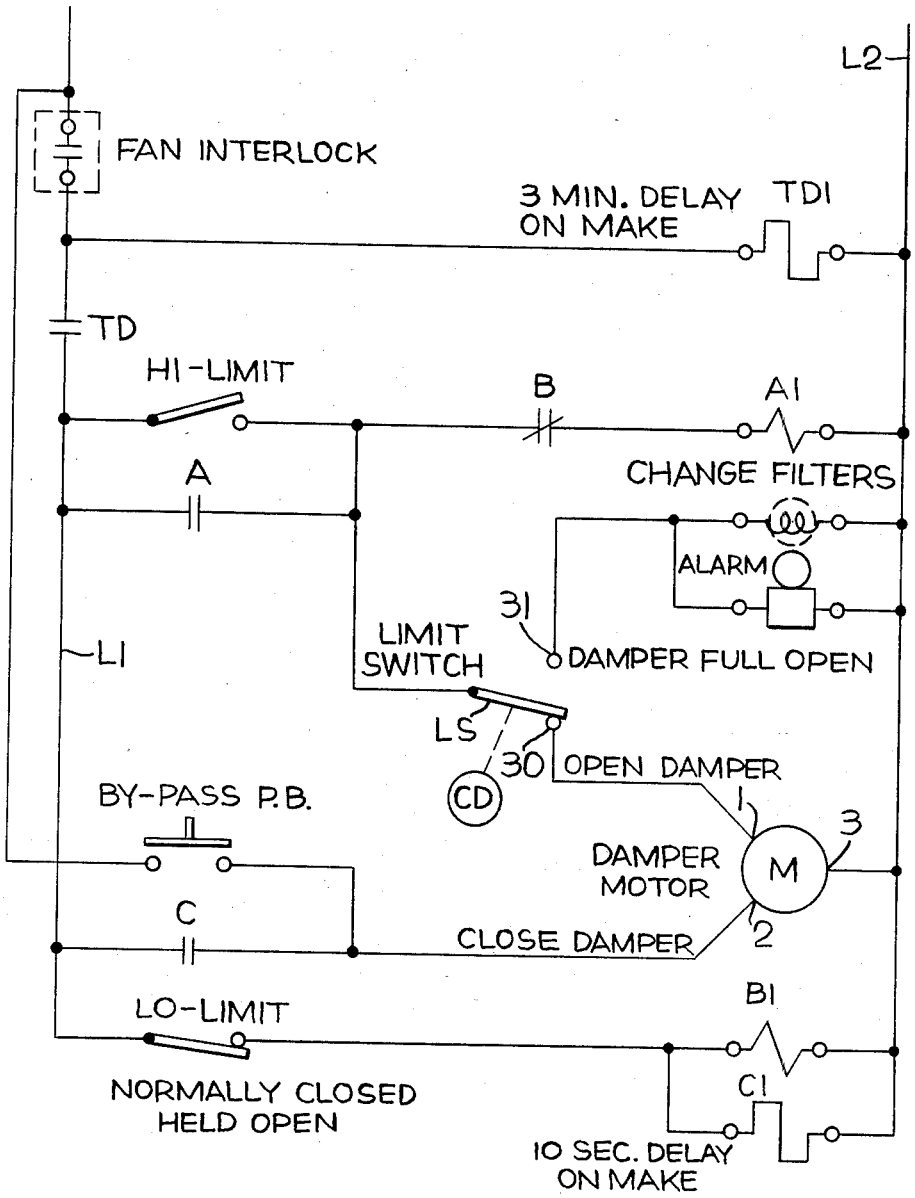
FIG. 3 is a schematic electrical circuit diagram of the air flow system of FIGS. 1 and 2.

Referring to the electrical control circuit of FIG. 3, the electrical power buses for system 10 are shown as L1 and L2. The normally open contacts of a FAN INTERLOCK relay are interposed between the power source (not shown) and L1 which disconnects the electrical control system when fan 11 is turned off and is necessary to prevent erratic or false operation. The operating coil of a time delay relay TD1 is connected between busses L1 and L2 beyond the FAN INTERLOCK contacts. TD1 has a pair of normally open contacts TD interposed in bus L1 which close approximately three minutes after the FAN INTERLOCK contacts close to energize coil TD1.

Relay TD1 allows fan 11 to come up to speed before contacts TD close to connect bus L1 to the power source.

The normally open high limit contacts HI-LIMIT of photohelic switch PDPS are connected across busses L1 and L2 in series with the normally closed contacts B of a disabling relay B1 and the operating coil of an air volume increasing (or damper opening) relay A1. Normally open contacts A of relay A1 are connected in parallel with the HI-LIMIT contacts of PDPS switch. The junction between the HI-LIMIT contacts and the B contacts is connected through the normal closed contacts of a limit switch LS to one end (designated terminal 1) of the winding of control damper motor M whose midtap (designated terminal 3) is connected to bus L2. Closure of the HI-LIMIT contacts energizes motor M in a direction to open control damper CD. Limit switch LS is a component of control damper CD and is operated only when damper CD is fully open.

The normally open low limit LO-LIMIT contacts of photohelic switch PDPS are connected between busses L1 and L2 in series with the parallel arrangement of the operating coil of disabling relay B1 and the operating coil of a time delay air volume decreasing relay C1 which closes its normally open contacts C approximately ten seconds after C1 is energized. Contacts C are connected between bus L1 and the other end (designated terminal 2) of the winding of damper control motor M so that energization of C1 closes contacts C after a ten second delay and energizes motor M in a direction to shut control damper CD. A BY-PASS push button is connected between the power source (not shown) and terminal 2 of the winding of motor M and may be used on start-up of the air flow control to bypass the electrical control and energize motor M to close damper CD, thereby allowing the electrical control to reach normal operation more quickly than if the FAN INTERLOCK relay were utilized.

MANNER OF OPERATION

Assume that the static pressure differential of volume control system 10 has not risen to 4.9" W.C. upon start-up. After a three minute time delay subsequent to closing of FAN INTERLOCK contacts to energize coil TD1, contacts TD close and energize bus L1. Since the static pressure differential is less than 4.9" W.C., LO-LIMIT contacts are closed and energize the operating coils of relays B1 and C1. Disabling relay B1 operates and opens its NC contacts B to prevent energization of relay A1. After a ten second delay (which ensures that damper control motor is stopped) contacts C of time delay relay C1 close and energize motor M in a direction to shut damper DC. Motor M continues to close volume control damper CD until the static differential pressure rises slightly above 4.9" W.C., at which time LO-LIMIT contacts open and de-energize relays B1 and C1. Relay B1 releases and closes contacts B to prepare for operation of relay A1. Contacts C of relay C1 open and interrupt power to motor M of damper control DC, thereby preventing further shutting of damper control DC.

As the static pressure builds up across fixed-resistance filters RF, EF and HEP with time, a point is reached when the system static differential pressure reaches 5.0 W.C., thereby closing the HI-LIMIT contacts to: (a) energize the operating coil of air volume increasing relay A1 through contacts B of disabling relay B1, and (b) energize terminal 1 of damper motor M through limit switch LS to operate damper control DC in a direction to open the damper. Relay A1 closes its contacts A to lock relay A1 operated and maintain motor M energized in a direction to open the damper and increase the volume of air flowing in system 10.

When control damper CD is thus being opened, the static differential of system 10 is reduced until it decreases below 4.9" W.C., at which point LO-LIMIT contacts close to thereby energize relays B1 and C1. Relay B1 operates its NC contacts B to de-energize relay A1. After a ten second delay, relay C1 closes contacts C to energize terminal 2 of damper control motor M and actuate motor M in a direction to close, or shut, volume control damper CD. Actuation of motor M in a direction to close damper CD continues until the static differential pressure rises above 4.9" W.C., at which point LO-LIMIT contacts open and de-energize relays B1 and C1. Opening of contacts C of relay C1 interrupts the circuit to damper motor M.

Such cycles of alternate opening and closing of HI-LIMIT and LO-LIMIT contacts (and actuation of variable resistance control damper CD in opposite directions) repeats, and with each cycle volume control damper CD is caused to be more fully open. The lesser pressure differential is required across the control damper CD because of the increase in pressure differential across fixed-resistance filters RF, EF and HEP.

Assume now that damper CD is fully open and the system 10 static differential pressure has reached 5.0" W.C. The HI-LIMIT contacts now close to energize relay A1 through contacts B and lock relay A1 in operated condition, thereby energizing terminal 1 of the winding of motor M and opening limit switch LS. Limit switch LS has a movable contact which normally engages a "break" stationary contact 30 connected to terminal 1 of tne winding of motor M and is adapted when operated to engage a "make" contact 31 connected to: (1) one side of an alarm bell ALARM whose other terminal is connected to bus L2; and (2) one side of a "CHANGE FILTERS" light. Operation of limit switch LS thus de-energizes control damper motor M and energizes the ALARM bell and the "CHANGE FILTERS" lights. It will be appreciated that the ALARM bell and the CHANGE FILTERS lights are optional components and could be replaced by a relay or other device for interfacing with a computer.

The embodiments of this invention in which an exclusive property or privilege is claimed are defined as follows:

1. In an air volume control ventilation system having a fan (11) for supplying air through ductwork and fixed-resistance filter means (RF,EF) including an electrostatic filter;

a variable resistance control damper (CD) in said system, said control damper including an actuator (M) adapted when energized in first and second directions, respectively, to operate said control damper in opening and in closing directions to increase and to decrease the volume of air flowing in said system, respectively, and thereby adjust the system differential pressure; and means for monitoring the static pressure differential across said fan including a differential pressure switch (PDPS) connected across said fan having high limit normally open contacts and an air volume increasing relay means (A1) having an operating coil in series with said high limit contacts and with a pair of normally open contacts (A) in parallel with said high limit contacts for completing a first circuit to actuate said control damper in said opening direction when said static pressure differential rises to a first predetermined limit, and means including a low limit normally open contact which closes only when said static pressure differential falls below a second predetermined limit for completing a second circuit to actuate said control damper in said closing direction to close said damper when said differential pressure decreases below said second predetermined limit.

2. In the system of claim 1 wherein said means for completing said second circuit includes time delay relay means (C1) having an operating coil in series with said low limit contacts for completing a circuit to energize said actuator in said second direction a predetermined time limit subsequent to closing of said low limit contacts.

3. In the system of claim 2 and also including a disabling relay (B1) having an operating coil in series with said low limit contacts and a pair of normally closed contacts (B) in series with said operating coil of said air volume increasing relay (A1) for disabling said air volume increasing relay and said locking circuit upon closure of said low limit contacts, whereby said damper (CD) is alternately open and shut and the differential pressure across said fan (11) is maintained in a narrow band between said first and second predetermined limits.

4. In the system of claim 3 and including a limit switch (LS) having a pair of normally closed contacts through which said first circuit is completed and being operated by said damper to open said pair of contacts when said damper is in fully open position, and alarm means actuated upon operation of said limit switch.

5. In the system of claim 1 and including a time delay relay (TD1) for delaying application of electrical power to said actuator and to said system upon initial turning on of said fan until said fan comes up to full speed.

6. In the system of claim 1 and including bypass switch means for selectively completing an energizing circuit to said actuator in said second direction.

7. In an air volume control ventilation system having a fan (11) supplying air through ductwork and fixed-resistance filter means (RF,EF);

a control damper (CD) in said system adapted when operated in opposite directions to respectively open, and thus increase, and to close, and thus decrease, the volume of air flowing through said system;

a differential static pressure switch (PDPS) connected across said fan and being provided with a high limit set of contacts adapted to operate when the static differential pressure across said fan rises to a first predetermined limit and a low limit set of contacts adapted to operate when said static differential pressure decreases below a second predetermined limit;

an actuator (M) adapted when energized in opposite directions, respectively, to open and to close said control damper (CD); and means responsive to operation of said high limit and low limit sets of contacts, respectively, to complete energizing circuits to said actuator in said opposite directions to open and to close said control damper, said means responsive to operation of said high limit contacts including an air volume increasing relay (A1) having an operating coil in series with said high limit contacts and a set of normally open contacts (A) in parallel with said high limit contacts and said means responsive to operation of said low limit contacts also including a time delay relay (C1) having an operating coil in series with said low limit contacts and a pair of normally open contacts (C) in parallel with said low limit contacts.

8. In the system of claim 7 and including a disabling relay (B1) having an operating coil in series with said low limit contacts and a pair of normally closed contacts (B) in series with the operating coil of said air volume increasing relay (A1).

9. In an air volume control ventilation system having a fan (11) for supplying air through ductwork and fixed-resistance filter means (RF,EF) including an electrostatic filter;

a variable resistance control damper (CD) in said system adapted to be operated by actuator means (M), said actuator means including a damper motor for operating said control damper (CD) in opening and closing directions, respectively, when said damper motor is energized in opposite directions;

a differential static pressure switch (PDPS) connected across said fan and being provided with sets of high limit contacts and low limit contacts which operate when the static differential pressure across said fan, respectively, rises to a first predetermined limit and falls below a second predetermined limit; and means responsive to operation of said high limit and said low limit sets of contacts, respectively, for completing energizing circuits to said actuator means (M) to energize said actuator means in said opposite directions, said means for completing said energizing circuits to said actuator means in said opposite directions including first (A1) and second (C1) relay means having operating coils in series with said high limit contacts and said low limit contacts, respectively, and pairs of normally open contacts (A) and (C) in parallel with said high limit contacts and said low limit contacts, respectively.

10. In the control system of claim 9 wherein said second relay means is of the type which is slow-to-operate and including a disabling relay (B1) having an operating coil in series with said low limit contacts and a pair of normally closed contacts (B) in series with said operating coil of said first relay means (A1).

* * * * *